US005694105A

United States Patent [19]

Weiner

[11] Patent Number: 5,694,105

[45] Date of Patent: Dec. 2, 1997

[54] COIL FORMER HAVING TWO WINDING CHAMBERS

[76] Inventor: Marlene Weiner, Huckeswagener Str. 19, D51647 Gummersbach, Germany

[21] Appl. No.: 726,517

[22] Filed: Oct. 7, 1996

[30] Foreign Application Priority Data

Nov. 7, 1995 [DE] Germany ..... 195 41 446.2

[51] Int. Cl.[6] ..... H01F 27/29; H01F 27/30

[52] U.S. Cl. ..... 336/198; 336/193; 336/208; 336/192

[58] Field of Search ..... 336/208, 198, 336/192

[56] References Cited

U.S. PATENT DOCUMENTS

| | | | |
|---|---|---|---|
| 3,496,505 | 2/1970 | Johannsen et al. | 336/208 |
| 4,503,413 | 3/1985 | Stalzer | 336/208 |
| 5,008,644 | 4/1991 | Cooper | 336/208 |

FOREIGN PATENT DOCUMENTS

| | | | |
|---|---|---|---|
| 60-7114 | 1/1985 | Japan | 336/198 |
| 63-175406 | 7/1988 | Japan | 336/208 |

*Primary Examiner*—Michael L. Gellner
*Assistant Examiner*—Anh Mai
*Attorney, Agent, or Firm*—Howard & Howard

[57] ABSTRACT

A coil former includes an opening and two winding chambers. Flanges are formed on opposing ends of the winding body and extend in planes transverse to a longitudinal axis of the opening. Connecting ledges are formed on at least one of the flanges and receive soldering terminals arranged side-by-side in a row. The soldering terminals receive winding wires wound about the winding body. The soldering terminals are cylindrical pins which are embedded in bases. The pins extend vertically from the bases and in a plane perpendicular to a longitudinal axis. The bases are spaced apart from one another, with each base tapering on a side facing an associated pin. Reinforcing ribs are formed on a side of the connecting ledge facing the opening.

12 Claims, 3 Drawing Sheets

COIL FORMER HAVING TWO WINDING CHAMBERS

BACKGROUND OF THE INVENTION

The present invention relates to a coil former having a winding body containing an opening extending therethrough for accommodating a core. On both ends of the winding body, flanges are formed which extend in a plane transverse to the longitudinal axis of the opening. At least one flange has a connecting ledge integrally formed with the flange and having at least four soldering terminals arranged side by side in a row for receiving winding wires wound about the winding body.

A coil former of the above-mentioned type is known from DE 32 41 408 C2. The soldering terminals are designed as soldering tags having an essentially rectangular flat cross-section wherein the width of the cross-section is considerably larger than its height. The ends of the winding wires wound about the tags are connected to the tags by soldering. During this soldering process, changes in the length of the winding wire occur due to the high soldering temperature and subsequent cooling. These changes in length increase the tensile stress within the winding wire. This may impair the soldering quality and cause the winding wire to be damaged or torn off during operation under varying work temperatures. Furthermore, with the known coil former, winding the winding wire about the soldering tag in an automatic winding machine is laborious. This is true, since the path along which the winding wire is guided from the winding chamber to the soldering tag is complicated. Because of the small height of the cross-section of the soldering tag, the winding wire has to be bent with a small radius of curvature. Thus, the winding wire may break or be torn off at the edges of the soldering tags if it is pulled tightly. A further disadvantage of the known coil former consists in that the winding wires have to have a relatively large diameter if a high current load is applied. Because of the flat cross-section, the soldering tags are likely to be bent when thick winding wires are wound about them.

SUMMARY OF THE INVENTION

It is the object of the invention to provide a coil former which has a stable construction, permits simple automatic winding and operates reliably.

This object is achieved for a coil former of the above-mentioned type by designing the soldering terminals as essentially cylindrical pins embedded in bases in a plane perpendicular to the longitudinal axis. The pins extend vertically from the bases. The bases are spaced apart from one another and each base tapers on the side facing the associated pin. Reinforcing ribs are formed on the side of the connecting ledge facing the opening.

According to the invention, the soldering terminals are designed as essentially cylindrical pins. The cylindrical shape makes it possible to wind the end of a winding wire tightly about the pin without risk of tearing or breaking off the winding wire on sharp edges. The cylindrical pins may be relatively sturdy and may, e.g., have a diameter of 1 mm. This means that thick winding wires can be wound tightly about the pins without bending the pins.

The pins are embedded in bases that are spaced apart from one another. Each base tapers on the side facing the associated pin. The side face of the base inclined towards the pin prevents the winding wire from becoming entangled. Furthermore, the base increases the distance from the supporting surface of the connecting ledge. This distance makes it easier to connect the ends of the winding wires wound about the pins to the pins by soldering. The bases are made of an insulating material and further serve to deflect the winding wires so that stress relief is achieved for each winding wire. This also compensates for the tensile stresses occurring during soldering due to the changes in temperature.

Further, reinforcing ribs are formed on the side of the connecting ledge facing the opening, and improve the mechanical stability of the connecting ledge. Since the connecting ledge is integrally connected to the associated flange, the mechanical stability of the flange and thus the mechanical stability of the entire coil former is improved.

Due to the clear-cut arrangement of the pins and the winding body and due to the fact that the pins are perpendicular to the winding body, all winding wires can be guided easily from the winding chamber to the pin in an automatic winding machine.

According to a preferred embodiment of the invention, the bases of the connecting ledge are spaced by a predetermined distance from the opposite side wall of the flange, thereby creating a guiding path along which the winding wire or winding wires are guided. Furthermore, this arrangement ensures that the winding wires are insulated and separated from the core.

According to an embodiment of the invention, the flange supports at least one spacer extending vertically in the direction of the cylindrical pins. The end of the spacer extends beyond the height of the winding wire wound about the pin or the height of the associated solder. The spacer serves to establish a predefined distance relative to a printed board, so that the end of the winding wire wound about the pin and connected to it by soldering has a sufficient distance from through holes formed in the printed board to prevent faulty soldering caused by covered through holes.

According to another embodiment, the side wall of the flange facing the connecting ledge has recesses through which the winding wire or winding wires are guided from the winding body. These recesses provide separating openings which permit the wires to be guided from the winding body to the connecting ledge without crossing each other.

BRIEF DESCRIPTION OF THE DRAWINGS

An embodiment of the invention will be described in detail with reference to the accompanying drawings, wherein.

DETAILED DESCRIPTION OF A PREFERRED EMBODIMENT

Figure 1:
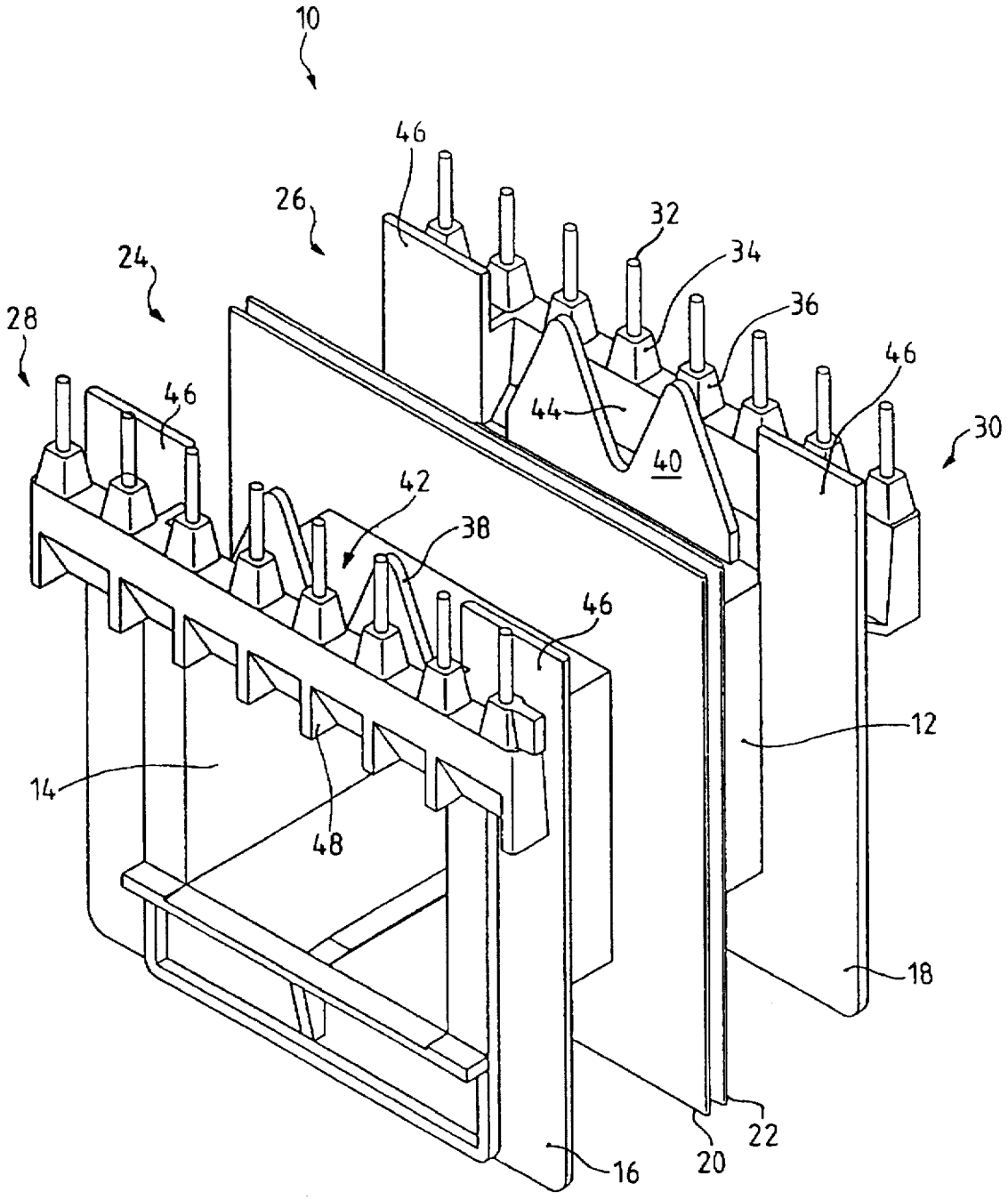
FIG. 1 is a perspective view of the new coil former having two winding chambers.

FIG. 1 is a perspective view of an embodiment of coil former 10 of the invention. The coil former 10 is formed in one piece from plastic material, and preferably from a glass fibre reinforced polyamide. The coil former has a continuous winding body 12 with an opening 14 extending therethrough for accommodating a core (not shown). Flanges 16, 18 extending in a transverse plane are formed on the ends of the winding body 12. Further, two central flanges 20 and 22 are centrally arranged on the winding body 12. The central flanges extend in planes that are perpendicular to the longitudinal axis of the opening 14. The flanges 16, 18, 20, 22 axially delimit two winding chambers 24, 26 adapted to receive windings (not shown).

Connecting ledges 28, 30 are formed on the two outer flanges 16, 18. The connecting ledges 28, 30 support pins 32. For better clarity, only one of the pins is identified by the reference number 32. The pins 32 are aligned along a straight line on each connecting ledge 28, 30 and have an essentially cylindrical shape. The pins 32 are embedded in bases 34. Only one of the bases is identified by the reference number 34. The pins of each connecting ledge 28, 30 extend vertically in a plane perpendicular to the longitudinal axis of the opening 14. Each base 34 has a square bottom surface and tapers in the direction towards the pin 32. The side faces of the bases 34 are trapezoid.

On the side opposite the connecting ledges 28, 30, the flanges 16, 18 have side walls 38, 40 spaced apart from the bases 34. Because of the spacing, a guiding path for the winding wires is created between the side walls 38, 40. The side walls 38, 40 further have recesses 42, 44 through which the winding wire or winding wires can be guided from the winding chambers 24 or 26 to the connecting ledges 28, 30 and the pins 32 in a predefined manner, and without crossing each other.

Each flange 16, 18 has two spacers 46 extending vertically in a direction parallel to the cylindrical pins 32. The ends of the spacers extend beyond the height of the winding wires wound about the pins 32 or the height of the associated soldering material.

On the side facing the opening 14, each connecting ledge 28, 30 has reinforcing ribs 48 which improve its mechanical stability. Since the coil former 10 is formed of one piece, as already mentioned above, the overall mechanical stability of the coil former 10 is improved by the reinforcing ribs 48.

Figure 2:
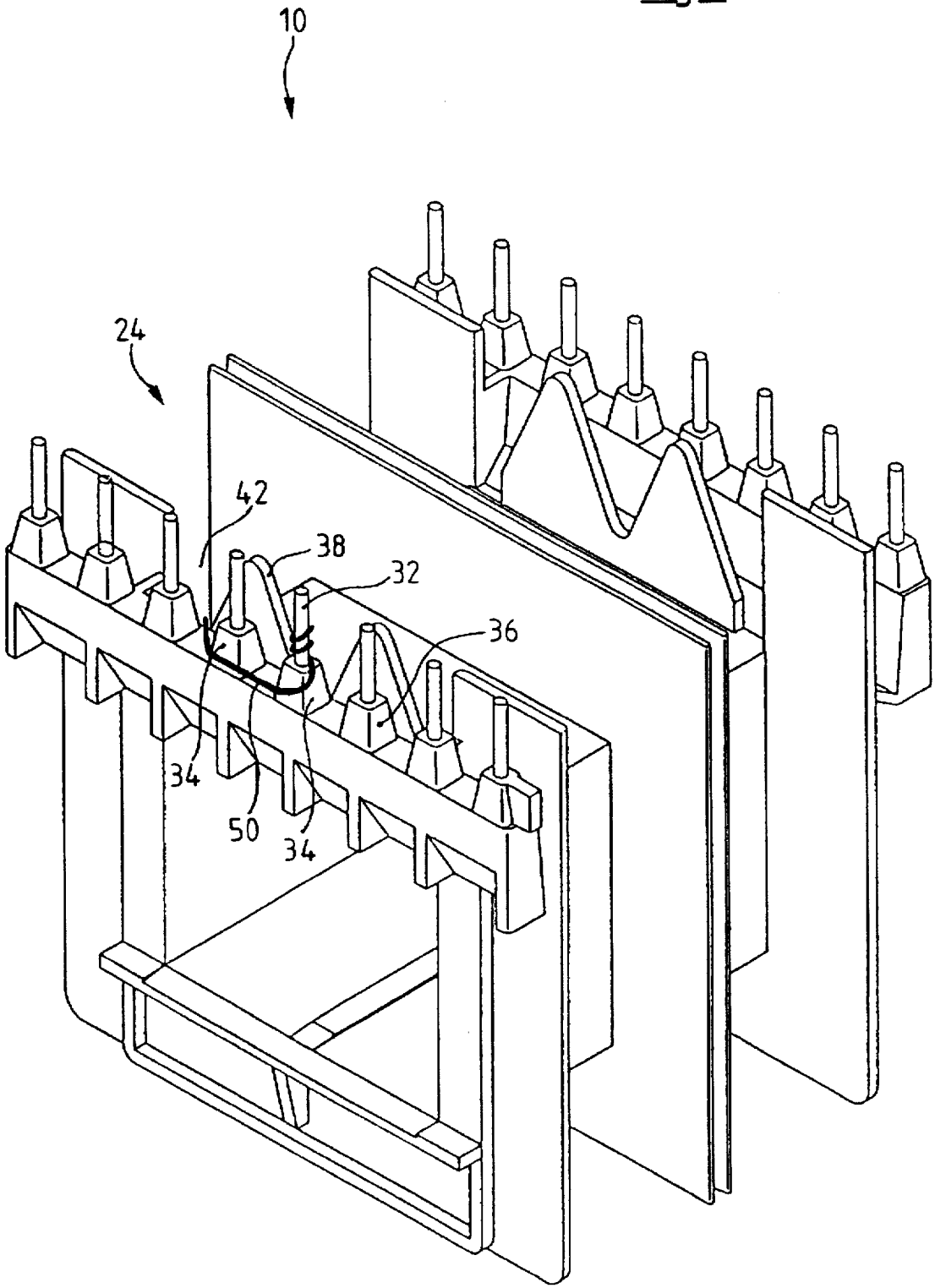
FIG. 2 is a schematic view of the coil former of FIG. 1 with the end of a winding wire wound about a pin.

FIG. 2 shows the coil former 10 of FIG. 1 with a winding wire 50. The winding wire 50 passes from the winding chamber 24 through one of the separating openings 42 in the side wall 38 and is deflected about two bases 34. One end of the winding wire 50 is then wound about the pin 32. Due to the inclined side faces 36, the wire 50 cannot become entangled even if the winding is carried out automatically. By deflecting the winding wire 50 about the two bases 34, strain relief is provided which compensates tensile stresses occurring due to temperature changes during soldering.

Figure 3:
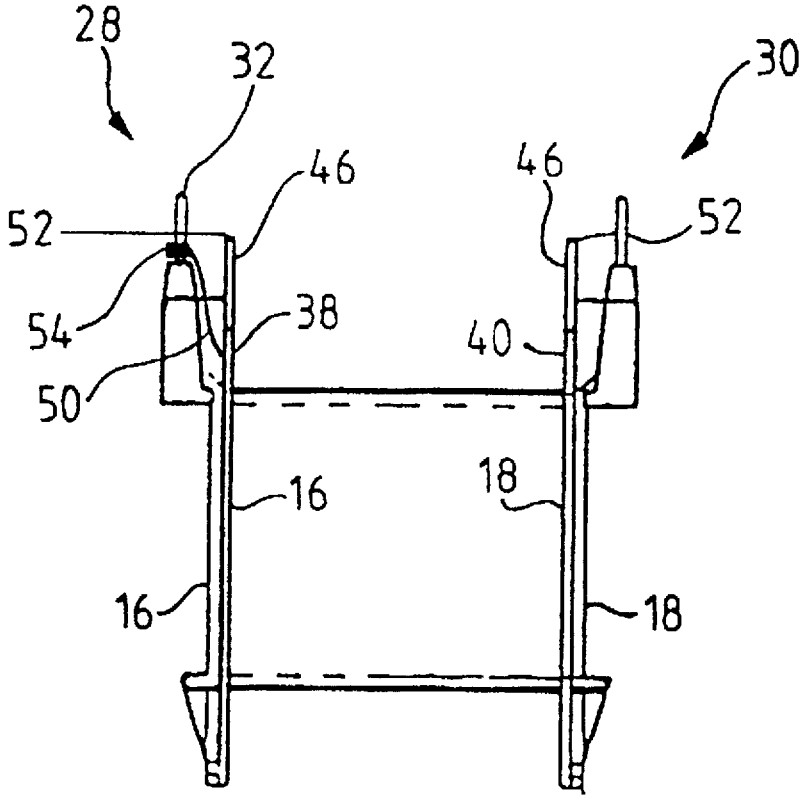
FIG. 3 is a schematic side view of the coil former of FIG. 1.

FIG. 3 is a schematic side view (not showing the central flanges 20, 22) which shows the dimensioning of the height of the spacers 46. The ends 52 of the spacers 46 extend beyond the solder 54 of a pin 32 supporting a wire end. The spacers 46 thus establish a predefined distance from a printed board (not shown) arranged on the side of the pins. The height of each spacer 46 is such that a winding wire 50 wound about the pin 32 as well as the associated solder 54 are situated at a sufficient distance from the printed board to ensure that neither the end of the winding wire 50 nor the solder 54 obstruct the through hole on the printed board into which the pin 32 is inserted. Faulty soldering is thus prevented.

The pins 32 of both connecting ledges 28, 30 extend in planes that are parallel to the flanges 16, 18, and all the pins point in the same direction. It is thus possible to connect the ends of the winding wires 50 wound about the pins 32 with all the pins in a single soldering process, e.g. by dip soldering.

It should further be noted that the pins 28 preferably have a pair of flattened side faces so that there results a cylindrical shape with flattened sides. Further, the cylindrical surface is provided with a fluting. The area of transition between the flat side face and the cylindrical surface creates an edge for tearing off the winding wire wound about the pin.

I claim:

1. A coil former comprising:

an opening extending therethrough for accommodating a core, a winding body containing said opening and having flanges formed on opposed ends of said winding body, said flanges extending in planes transverse to a longitudinal axis of said opening, a connecting ledge formed on at least one said flange, said connecting ledge having at least four soldering terminals arranged side by side in a row for receiving winding wires wound about said winding body;

said soldering terminals being essentially cylindrical pins embedded in bases, said pins extending vertically from said bases and in a plane perpendicular to a longitudinal axis and wherein said bases are spaced apart from one another;

each said base tapers on a side facing an associated pin; and reinforcing ribs formed on a side of said connecting ledge facing said opening.

2. A coil former according to claim 1, wherein said bases of said connecting ledge are arranged at a predetermined distance from an opposite side wall of said flange, thereby creating a space through which the winding wire or the winding wires are guided.

3. A coil former according to claim 1, wherein said flange has at least one spacer extending vertically in the direction of said cylindrical pins, and that an end of said spacer extends beyond a height of the winding wire wound about the pin or the height of the associated solder.

4. A coil former according to claim 1, wherein a side wall of said flange facing a connecting ledge has recesses through which the winding wire or the winding wires are guided from said winding body.

5. A coil former according to claim 1, wherein said cylindrical pins have a diameter of approximately 1 mm.

6. A coil former according to claim 1, wherein said winding body has two central flanges which form lateral boundaries for winding coils.

7. A coil former according to claim 1, wherein said coil former is formed by injection moulding.

8. A coil former according to claim 1, wherein both flanges have connecting ledges of an identical structure, and said cylindrical pins of both said connecting ledges extend in parallel planes.

9. A coil former according to claim 1, wherein each winding wire is deflected about at least two mutually adjacent bases before being wound about one said pin.

10. A coil former according to claim 1, wherein each base has a rectangular bottom surface and trapezoid side faces tapering in the direction towards said pin.

11. A coil former comprising:

a coil former body having an opening extending there through for accommodating a core, said body having flanges formed on opposed ends of said winding body, said flanges extending in planes transverse to a longitudinal axis of said opening;

a connecting ledge formed on at least one said flange, said connecting ledge having at least four soldering terminals arranged side-by-side in a row for receiving winding wires wound about said winding bodies; and said soldering terminals being essentially cylindrical pins embedded in bases, said pins extending vertically from said bases and in a plane perpendicular to a longitudinal axis and wherein said bases are spaced apart from one another, and each of said bases tapers on a side facing an associated pin.

12. A coil former as recited in claim 11, wherein reinforcing ribs are formed on a side of said connecting ledge facing said opening.

* * * * *